US008292462B2

(12) United States Patent
Huang et al.

(10) Patent No.: US 8,292,462 B2
(45) Date of Patent: Oct. 23, 2012

(54) LAMP SEAT STRUCTURE CAPABLE OF ADJUSTING LIGHT SOURCE SENSING DIRECTION

(76) Inventors: Tsun-Yu Huang, Changhua (TW); Cheng-Yi Huang, Changhua (TW)

( * ) Notice: Subject to any disclaimer, the term of this patent is extended or adjusted under 35 U.S.C. 154(b) by 434 days.

(21) Appl. No.: 12/574,454

(22) Filed: Oct. 6, 2009

(65) Prior Publication Data

US 2011/0080748 A1 Apr. 7, 2011

(51) Int. Cl.
*F21V 23/04* (2006.01)

(52) U.S. Cl. ..... 362/276; 362/249.02; 362/800; 362/802

(58) Field of Classification Search ..... 362/183, 362/386, 276, 249.02, 800, 802; 313/362, 313/307

See application file for complete search history.

(56) References Cited

U.S. PATENT DOCUMENTS

| | | | | |
|---|---|---|---|---|
| 6,161,938 | A * | 12/2000 | Kish et al. | 362/183 |
| 6,386,730 | B1 * | 5/2002 | Matthews | 362/184 |
| 2009/0224699 | A1 * | 9/2009 | Chi et al. | 315/362 |
| 2010/0290207 | A1 * | 11/2010 | Chan et al. | 362/20 |

* cited by examiner

*Primary Examiner* — Jason Moon Han
*Assistant Examiner* — Jessica M Apenteng
(74) *Attorney, Agent, or Firm* — Jackson IPG PLLC

(57) ABSTRACT

A lamp seat structure capable of adjusting light source sensing direction includes a connecting seat and a lampshade, or includes a connecting seat and a light bulb. The connecting base includes a base, a metallic lid, a cylinder, and a circuit modular board which are connected with an outer metallic conducting rod and an inner metallic conducting rod so as to be screwed to a light holder. A blocking board is located between a limit light trough of the cylinder and a light sensor of the circuit modular board. The circuit modular board is disposed under a partition. The circuit modular board is provided with a plurality of light emitting diodes for illumination. Alternatively, the circuit modular board is disposed and located on the partition, and a lower end of the cylinder is formed with an inner metallic threaded section for connecting with the light bulb. The lamp of the present invention is capable of sensing light and dark to turn on/off the lamp automatically.

9 Claims, 7 Drawing Sheets

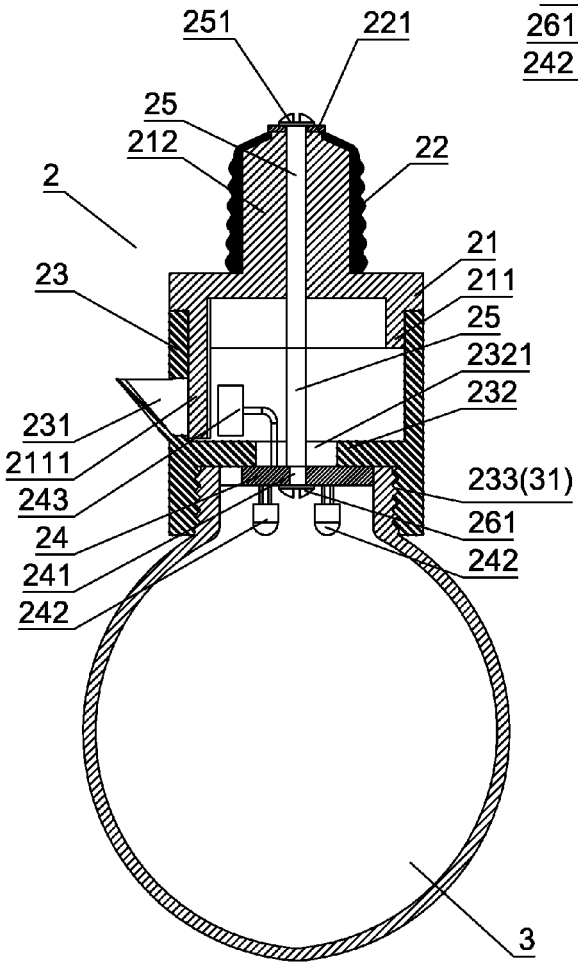
Fig. 3-A
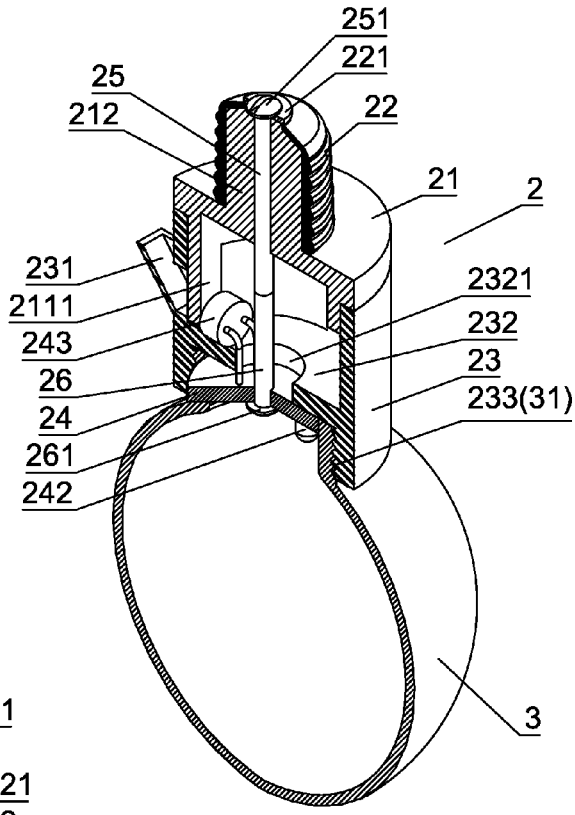
Fig. 3-B

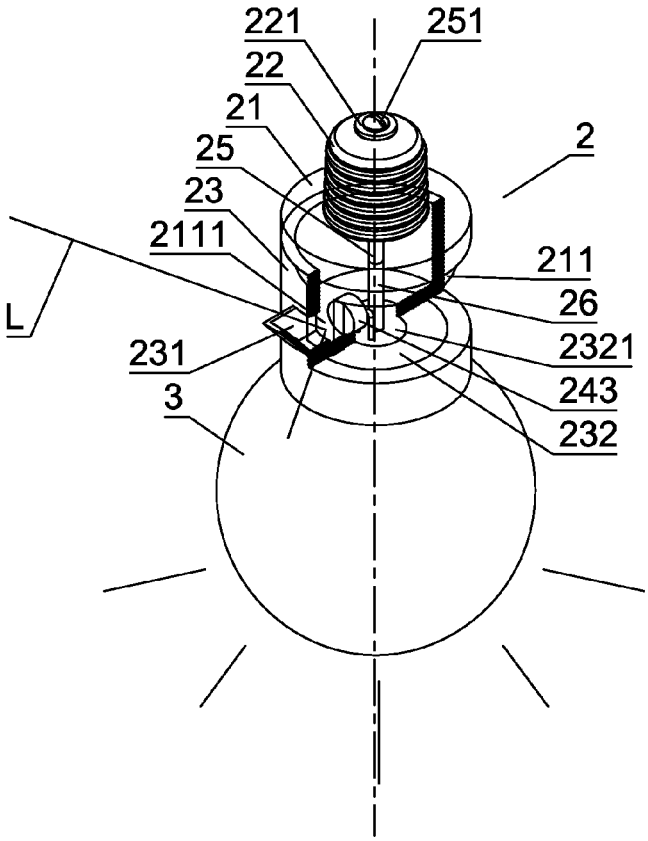
Fig. 4
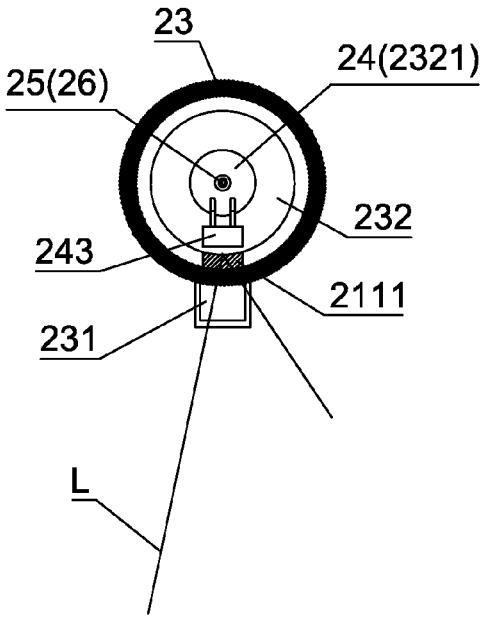
Fig. 4-A

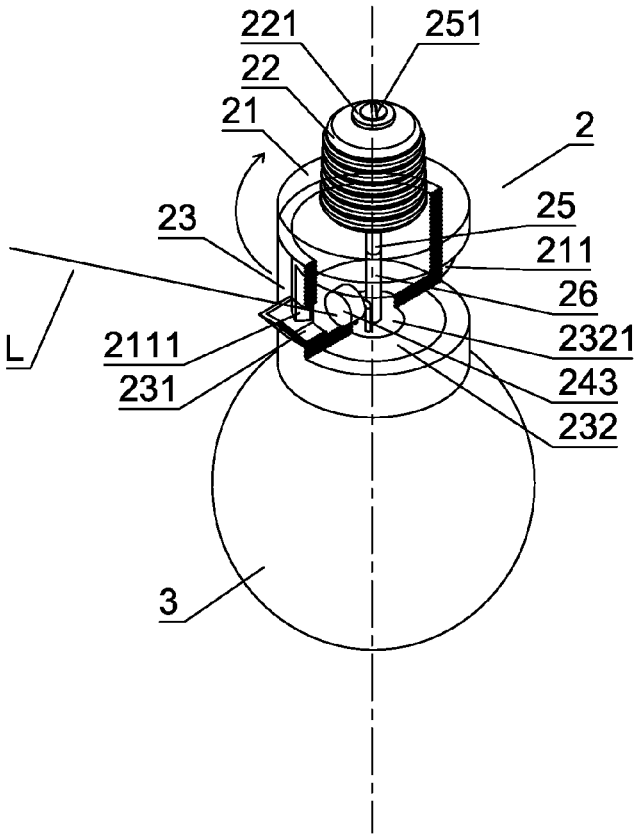
Fig. 5
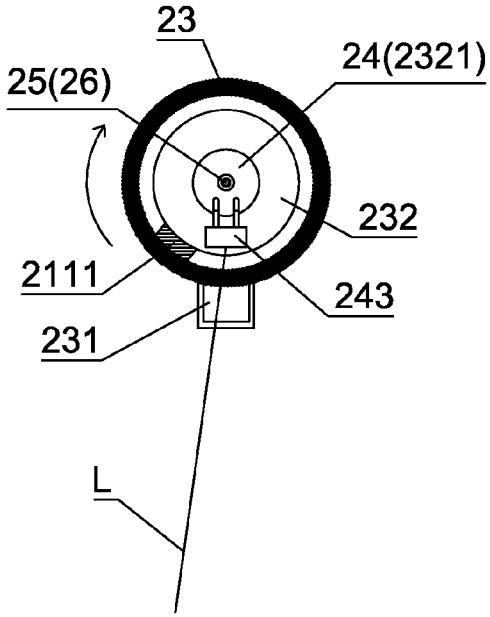
Fig. 5-A

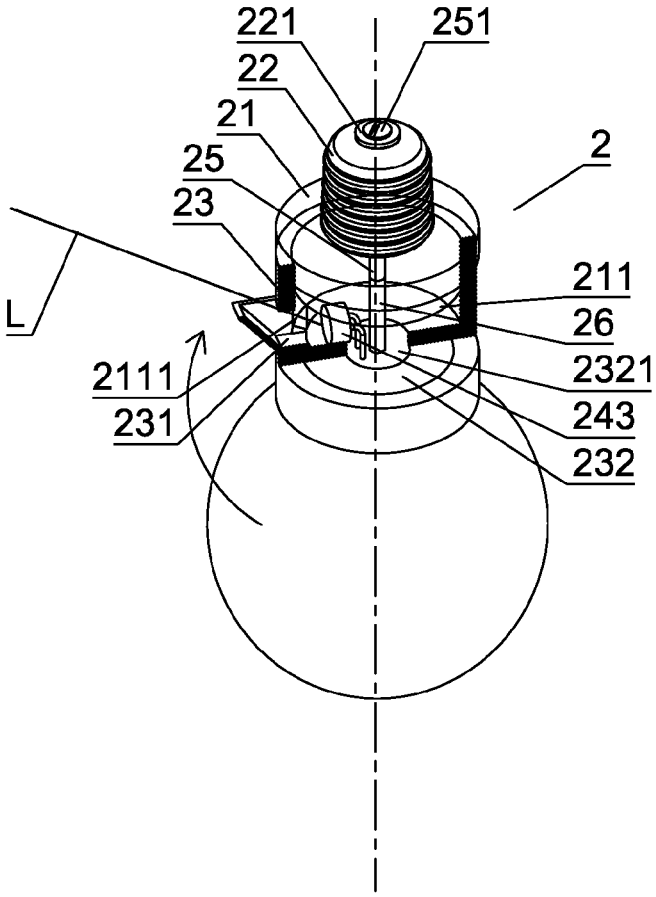
Fig. 6
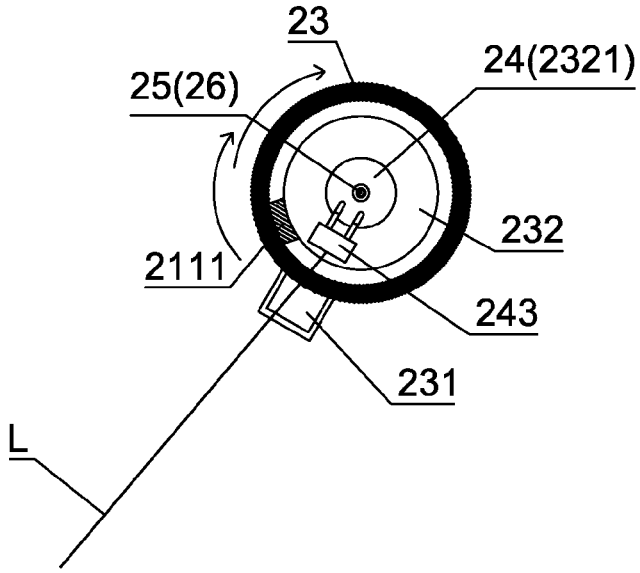
Fig. 6-A

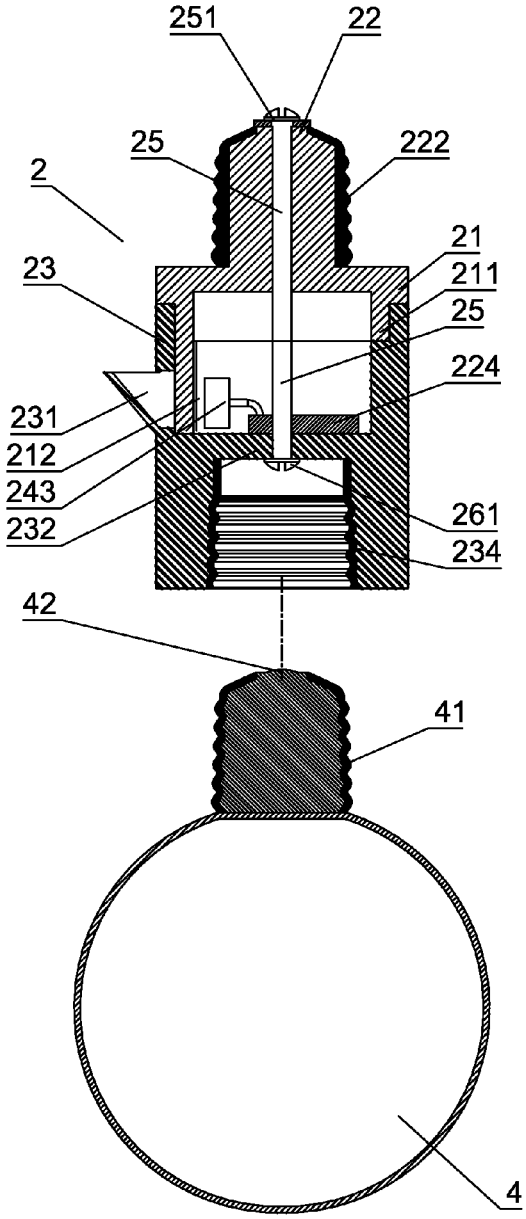
Fig. 7-A
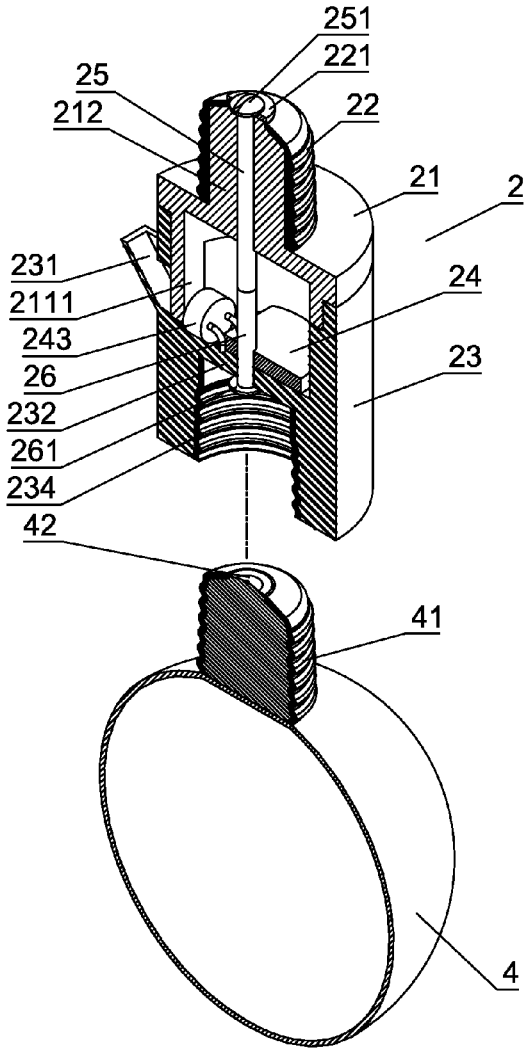
Fig. 7-B

LAMP SEAT STRUCTURE CAPABLE OF ADJUSTING LIGHT SOURCE SENSING DIRECTION

BACKGROUND OF THE INVENTION

1. Field of the Invention

The present invention relates to a lamp seat structure capable of adjusting light source sensing direction, and more particularly to one having an outer metallic conducting rod and an inner metallic conducting rod to connect a base, a metallic lid, a cylinder, and a circuit modular board together to form an integral lamp seat to be screwed to a normal lamp holder. With the circuit modular board disposed at a different position, the lamp radiates light through light emitting diodes or a light bulb. With a blocking board between a limit light trough and a sensing member, the lamp is selectively controlled to be in an automatic sensing status or in a constant illumination status for turning on/off the lamp automatically and adjusting the incidence of light source.

2. Description of the Prior Art

A conventional light bulb is screwed to a lamp holder, which is manually operated to turn on or turn off the light. An automatic lighting control device is mounted in a threaded trough of an original lamp holder and coupled with a light bulb. A light sensor is provided in the automatic lighting control device as a control switch. When there is light beam, the light will be in a disconnection status and turned off. When there is no light beam, the light will be in a connection status to illuminate. The prior art has the following shortcomings.

1. The conventional light bulb is used to illuminate. Sometimes, people always forget to turn off the light which is mounted at an arcade, balcony, porch, and the like. This causes wastage of energy from its unnecessary and inappropriate use. In these days, energy saving is very important.

2. The conventional automatic lighting control device uses the light sensor to sense the condition of light beam and control the lighting. Therefore, it is essential for aiming at the light source. The sensitivity of the automatic lighting control device is decided by the light sensor. Under some conditions, these areas need illumination for a long time, for example the house is repairing. There is no fine adjustment to the incidence of light source for the light in a constant illumination status on the market. Accordingly, the inventor of the present invention has devoted himself based on his many years of practical experiences to solve this problem.

SUMMARY OF THE INVENTION

According to the primary object of the present invention, there is provided a lamp seat structure capable of adjusting light source sensing direction. An inner ring of a base is fitted in a cylinder. An outer metallic conducting rod is inserted through a first through hole of an insulating pad and a second through hole of the cylinder in sequence so that a metallic lid is coupled on a post of the base. An inner metallic conducting rod is inserted through a fourth through hole of a circuit modular board and a third through hole of the cylinder. A threaded hole of the inner metallic conducting rod is engaged with a threaded rod of the outer metallic conducting rod such that the circuit modular board leans against a lower edge of a partition of the cylinder and a light sensor of the circuit modular board corresponds in position to a limit light trough of the cylinder. A lampshade is screwed to the cylinder, with an outer threaded section of the lampshade to engage with an inner threaded section of the cylinder to form a LED lamp which is screwed to a lamp holder. When the lamp is set in a constant illumination status, the base or the cylinder is turned to a position where the blocking board is aligned with the limit light trough for the blocking board to block an external light beam. The light sensor, not being shone by the light beam, is in a connection status for the plurality of light emitting diodes to illuminate continually. When the lamp is set in an automatic sensing status, the base or the cylinder is turned to a position where the blocking board is not aligned with the limit light trough such that the light sensor shone by the external light beam is in a disconnection status. The plurality of light emitting diodes are not electrically connected to illuminate. On the contrary, when the external light beam is blocked and the light sensor is in a connection status, the plurality of light emitting diodes are electrically connected to illuminate. The angle of the lamp with respect to the incidence of the light beam is adjustable. The cylinder is first turned for the limit light trough toward the light source at a proper angle, and then the base is turned to decide the lamp in an automatic sensing status or in a constant illumination status. Alternatively, the base and the cylinder are turned at the same time for the limit light trough toward the light source at a proper angle to maintain its original setting status. The present invention provides a dual selection for lighting.

According to a second object of the present invention, there is provided a lamp seat structure capable of adjusting light source sensing direction. The cylinder is formed with an inner metallic threaded section instead of the inner threaded section. The circuit board is located on the partition. The circuit modular board includes the fourth through hole and the light sensor corresponding in position to the limit light trough. The inner ring of the base is fitted in the cylinder. The outer metallic conducting rod is inserted through the first through hole and the second through hole in sequence so that the metallic lid is coupled on the post. The inner metallic conducting rod is inserted through the third through hole and the fourth through hole. The threaded hole is engaged with the threaded rod to form the connecting seat. The lampshade is replaced with a light bulb. The light bulb has an outer metallic threaded section and a top to engage with the inner metallic threaded section of the cylinder and the inner locking cap of the inner metallic conducting rod, respectively. The light bulb is screwed to the cylinder, with the outer metallic threaded section to engage with the inner metallic threaded section and the top to contact with the inner locking cap to form an automatic sensing light bulb which is replaceable.

BRIEF DESCRIPTION OF THE DRAWINGS

FIG. 3-A is a sectional view according to the first embodiment of the present invention;

FIG. 3-B is an oblique sectional view according to the first embodiment of the present invention;

FIG. 4 is a perspective view of the first embodiment of the present invention in a constant illumination status;

FIG. 4-A is a top sectional view of the first embodiment of the present invention in a constant illumination status;

FIG. 5 is a perspective view of the first embodiment of the present invention in an automatic sensing status;

FIG. 5-A is a top sectional view of the first embodiment of the present invention in an automatic sensing status;

FIG. 6 is a perspective view of the first embodiment of the present invention in an operating status to adjust the incidence of the light beam;

FIG. 6-A is a top sectional view of the first embodiment of the present invention in an operating status to adjust the incidence of the light beam;

FIG. 7 is a sectional view according to a second embodiment of the present invention; and FIGS. 7-A and 7-B are oblique sectional views according to the second embodiment of the present invention;

DETAILED DESCRIPTION OF THE PREFERRED EMBODIMENTS

Embodiments of the present invention will now be described, by way of example only, with reference to the accompanying drawings.

Figure 1:
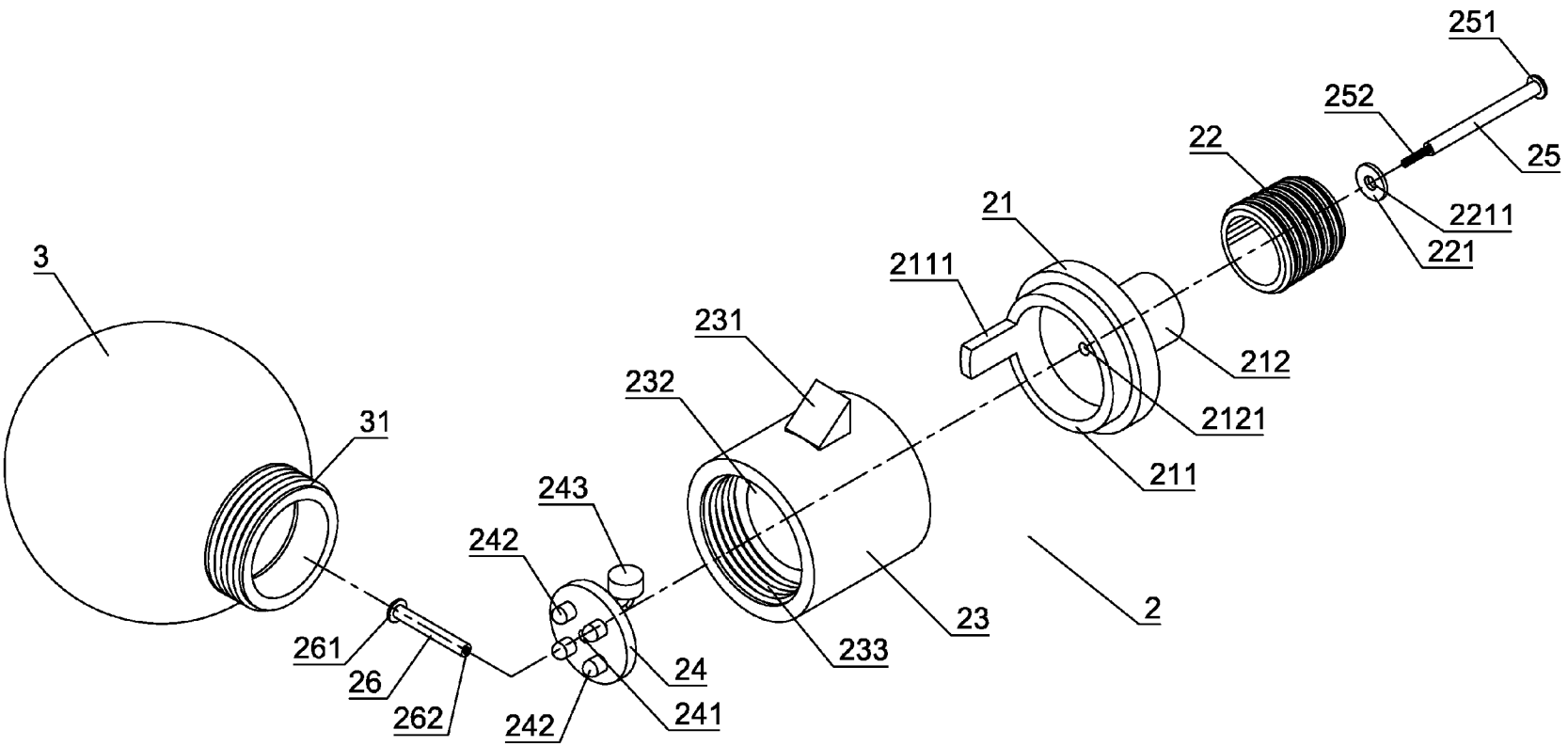
FIG. 1 is an exploded view according to a first embodiment of the present invention.
Figure 2:
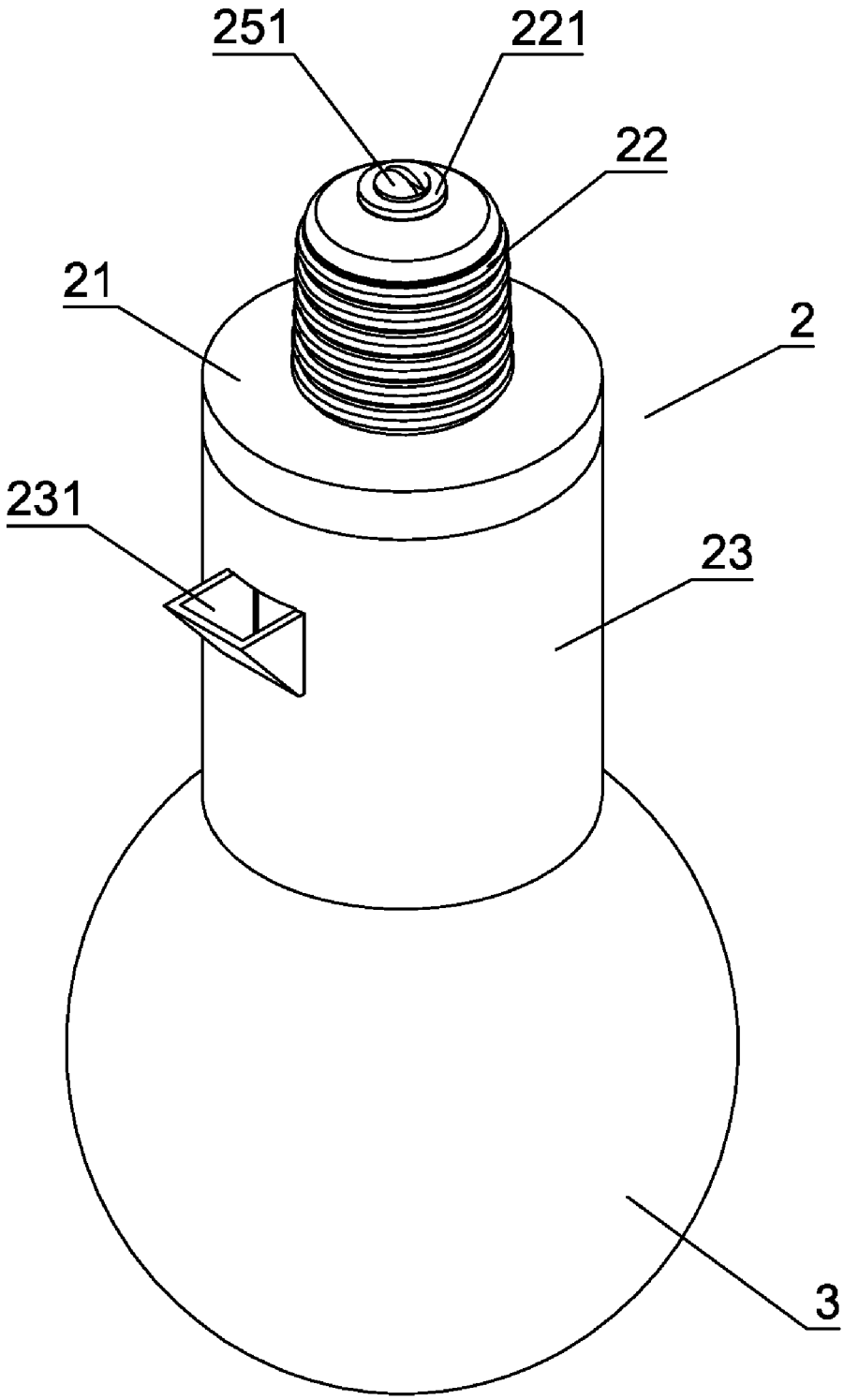
FIG. 2 is a perspective view according to the first embodiment of the present invention.

As shown in FIGS. 1, 2, 3-A, 3-B, a first embodiment of the present invention comprises a connecting seat 2, and a lampshade 3.

The connecting seat 2 comprises a base 21, a metallic lid 22, a cylinder 23, a circuit modular board 24, an outer metallic conducting rod 25, and an inner metallic conducting rod 26.

The base 21 includes an inner ring 211 extending from a lower end of the base 21, a blocking board 2111 extending from an edge of the inner ring 211, a post 212 extending from an upper end of the base 21, a second through hole 2121 formed at a central portion of the base 21.

The metallic lid 22 is fitted on the post 212, and includes an insulating pad 221 on top of the metallic lid 22. The insulating pad 221 has a first through hole 2211 at a central portion thereof.

The cylinder 23 includes a limit light trough 231 formed on an outer wall of a middle portion thereof, a partition 232 in the middle portion, and an inner threaded section 233 formed at a lower end thereof. The partition 232 has a third through hole 2321 at a central portion thereof.

The circuit modular board 24 includes a fourth through hole 241 at a central portion thereof, a plurality of light emitting diodes 242 on a bottom of the circuit modular board 24, a light sensor 243 extending from a top of the circuit modular board 24 and corresponding in height to the limit light trough 231.

The outer metallic conducting rod 25 includes an outer locking cap 251 at an upper end thereof and a threaded section 252 formed on a lower end thereof. The outer metallic conducting rod 25 is inserted in the first through hole 2211 of the insulating pad 221, the metallic lid 22, and the second through hole 2121 of the base 21 so that the metallic lid 22 is fitted on the post 212 of the base 21.

The inner metallic conducting rod 26 includes an inner locking cap 261 at a lower end thereof and a threaded hole 262 formed in an upper end thereof. The inner metallic conducting rod 26 is inserted in the fourth through hole 241 of the circuit modular board 24 and the third through hole 2321 of the cylinder 23, and the threaded hole 262 is engaged with the threaded section 252 of the outer metallic conducting rod 25 so that the circuit modular board 24 is confined to lean against a lower edge of the partition 232.

The lampshade 3 has a lamp head in a geometric shape, such as circle, rhombus, or ellipse. The lamp head has an outer threaded section 31 thereon, corresponding to the inner threaded section 233 of the cylinder 23.

To assemble the present invention, as shown in FIGS. 3-A, 3-B, 4 to 6, 4A to 6A, the outer metallic conducting rod 25 and the inner metallic conducting rod 26 are used to connect the base 21, the metallic lid 22, the cylinder 23, and the circuit modular board 24 together. The inner ring 211 of the base 21 is fitted in the cylinder 23. The outer metallic conducting rod 25 is inserted through the first through hole 2211 and the second through hole 2121 in sequence so that the metallic lid 22 is coupled on the post 212. The inner metallic conducting rod 26 is inserted through the fourth through hole 241 and the third through hole 2321 and the threaded hole 262 is engaged with the threaded rod 252 such that the circuit modular board 24 leans against the lower edge of the partition 232 and the light sensor 243 corresponds in position to the limit light trough 231. Finally, the lampshade 3 is screwed to the cylinder 23, with the outer threaded section 31 to engage with the inner threaded section 233 to form a LED lamp (as shown FIG. 3-A, 3-B) which is screwed to a lamp holder.

As shown in FIG. 4, FIG. 4-A, the lamp of the present invention is set in a constant illumination status. The base 21 or the cylinder 23 is turned to a position where the blocking board 2111 is aligned with the limit light trough 231 for the blocking board 2111 to block an external light beam L. The light sensor 243, not being shone by the light beam L, is in a connection status for the plurality of light emitting diodes 242 to illuminate continually.

As shown in FIG. 5, FIG. 5-A, the lamp of the present invention is set in an automatic sensing status. The base 21 or the cylinder 23 is turned to a position where the blocking board 2111 is not aligned with the limit light trough 231 such that the light sensor 243 shone by the external light beam L is in a disconnection status. The plurality of light emitting diodes 242 are not electrically connected to illuminate. On the contrary, when the external light beam L is blocked and the light sensor 243 is in a connection status, the plurality of light emitting diodes 242 are electrically connected to illuminate.

As shown in FIG. 6 and FIG. 6-A, the angle of the lamp with respect to the incidence of the light beam L is adjustable. The cylinder 23 is first turned for the limit light trough 231 toward the light source at a proper angle, and then the base 21 is turned to decide the lamp in an automatic sensing status or in a constant illumination status. Alternatively, the base 21 and the cylinder 23 are turned at the same time for the limit light trough 231 toward the light source at a proper angle to maintain its original setting status. The present invention provides a dual selection for lighting so as to match with the position of the light source.

Referring to FIG. 2, FIG. 3-A, FIG. 3-B, the outer threaded section 31 of the lampshade 3 and the inner threaded section 233 of the cylinder 23 are formed with a plurality of engaging notches and a plurality of engaging blocks, respectively, for engagement. Alternatively, the outer threaded section 31 of the lampshade 3 and the inner threaded section 233 of the cylinder 23 are formed with an outer plane and an inner plane, respectively, to be coated with colloid for engagement.

Referring to FIG. 2, FIG. 7-A and FIG. 7-B show a second embodiment of the present invention, which is substantially similar to the first embodiment with the exceptions described hereinafter. The cylinder 23 is formed with an inner metallic threaded section 234 instead of the inner threaded section 233. The circuit board 24 is located on the partition 232. The circuit modular board 24 includes the fourth through hole 241 and the light sensor 243 corresponding in position to the limit light trough 231. The lampshade 3 is replaced with a light bulb 4. The light bulb 4 has an outer metallic threaded section 41 and a top 42 to engage with the inner metallic threaded section 234 of the cylinder 23 and the inner locking cap 261 of the inner metallic conducting rod 26, respectively. The inner ring 211 of the base 21 is fitted in the cylinder 23. The outer metallic conducting rod 25 is inserted through the first through hole 2211 and the second through hole 2121 in sequence so that the metallic lid 22 is coupled on the post 212. The inner metallic conducting rod 26 is inserted through the third through hole 2321 and the fourth through hole 241, and the threaded hole 262 is engaged with the threaded rod 252 to form the connecting seat 2. The light bulb 4 is screwed to the cylinder 23, with the outer metallic threaded section 41 to engage with the inner metallic threaded section 243 and the top 42 to contact with the inner locking cap 261 to form an automatic sensing light bulb 4 which is replaceable.

Referring to FIG. 1 and FIG. 7-A, the metallic lid 22, the inner metallic threaded section 234, the outer metallic conducting rod 25, the inner metallic conducting rod 26, the outer metallic threaded section 41 are made of copper as conductive members.

The lamp of the present invention is capable of sensing light and dark to turn on/off the lamp automatically.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A lamp seat structure capable of adjusting light source sensing direction, comprising:

a connecting seat comprising a base, a metallic lid, a cylinder, a circuit modular board, an outer metallic conducting rod and an inner metallic conducting rod; the base including an inner ring extending from a lower end of the base, a blocking board extending from an edge of the inner ring, a post extending from an upper end of the base, a second through hole formed at a central portion of the base; the metallic lid being fitted on the post and including an insulating pad on top of the metallic lid, the insulating pad having a first through hole at a central portion thereof; the cylinder including a limit light trough formed on an outer wall of a middle portion thereof, a partition in the middle portion, and an inner threaded section formed at a lower end thereof, the partition having a third through hole at a central portion thereof, the base and the cylinder being selectively rotatable with respect to one another; the circuit modular board including a fourth through hole at a central portion thereof, a plurality of light emitting diodes on a bottom of the circuit modular board, a light sensor extending from a top of the circuit modular board and corresponding in height to the limit light trough; the outer metallic conducting rod including an outer locking cap at an upper end thereof and a threaded section formed on a lower end thereof, the outer metallic conducting rod being inserted in the first through hole of the insulating pad, the metallic lid, and the second through hole of the base so that the metallic lid being fitted on the post of the base; the inner metallic conducting rod including an inner locking cap at a lower end thereof and a threaded hole formed in an upper end thereof, the inner metallic conducting rod being inserted in the fourth through hole of the circuit modular board and the third through hole of the cylinder, the threaded hole of the inner metallic conducting rod being engaged with the threaded section of the outer metallic conducting rod so that the circuit modular board is confined to lean against a lower edge of the partition; and a lampshade having a lamp head in a geometric shape, the lamp head having an outer threaded section to engage with the inner threaded section of the cylinder;

thereby, the outer metallic conducting rod and the inner metallic conducting rod connecting the base, the metallic lid, the cylinder, and the circuit modular board together to be screwed to a lamp holder for the plurality of light emitting diodes disposed under the circuit modular board to illuminate, the blocking board being movable to selectively prevent light from reaching the light sensor through rotating the blocking board to block the limit light trough to select automatic illumination or constant illumination of the plurality of light emitting diodes.

2. The lamp seat structure capable of adjusting light source sensing direction as claimed in claim 1, wherein the lamp head is in the shape of circle, rhombus, or ellipse.

3. The lamp seat structure capable of adjusting light source sensing direction as claimed in claim 1, wherein the metallic lid, the outer metallic conducting rod, and the inner metallic conducting rod are made of copper as conductive members.

4. The lamp seat structure capable of adjusting light source sensing direction as claimed in claim 1, wherein the outer threaded section is formed with a plurality of engaging troughs and the inner threaded section is formed with a plurality of engaging blocks for engagement.

5. The lamp seat structure capable of adjusting light source sensing direction as claimed in claim 1, wherein the outer threaded section is formed with an outer plane and the inner threaded section is formed with an inner plane for engagement.

6. The lamp seat structure capable of adjusting light source sensing direction as claimed in claim 1, wherein the limit light trough extends away from the outer wall of the cylinder to form an opening facing the metallic lid.

7. A lamp seat structure capable of adjusting light source sensing direction, comprising:

a connecting seat comprising a base, a metallic lid, a cylinder, a circuit modular board, an outer metallic conducting rod and an inner metallic conducting rod; the base including an inner ring extending from a lower end of the base, a blocking board extending from an edge of the inner ring, a post extending from an upper end of the base, a second through hole formed at a central portion of the base; the metallic lid being fitted on the post and including an insulating pad on top of the metallic lid, the insulating pad having a first through hole at a central portion thereof; the cylinder including a limit light trough formed on an outer wall of a middle portion thereof, a partition in the middle portion, and an inner metallic threaded section formed at a lower end thereof, the base and the cylinder being selectively rotatable with respect to one another, the partition having a third through hole at a central portion thereof; the circuit modular board including a fourth through hole at a central portion thereof and a light sensor disposed on a top of the circuit modular board and corresponding in height to the limit light trough; the outer metallic conducting rod including an outer locking cap at an upper end thereof and a threaded section formed on a lower end thereof, the outer metallic conducting rod being inserted in the first through hole of the insulating pad, the metallic lid, and the second through hole of the base so that the metallic lid being fitted on the post of the base; the inner metallic conducting rod including an inner locking cap at a lower end thereof and a threaded hole formed in an upper end thereof, the inner metallic conducting rod being inserted in the third through hole of the cylinder and the fourth through hole of the circuit modular board, the threaded hole of the inner metallic conducting rod being engaged with the threaded section of the outer metallic conducting rod;

a light bulb having an outer metallic threaded section and a top to engage with the inner metallic threaded section of the cylinder and the inner locking cap of the inner metallic conducting rod, respectively;

thereby, the outer metallic conducting rod and the inner metallic conducting rod connecting the base, the metallic lid, the cylinder, and the circuit modular board together to be screwed to a lamp holder, the blocking board being movable to selectively prevent light from reaching the light sensor through rotating the blocking board to block the limit light trough to select automatic illumination or constant illumination of the light bulb.

8. The lamp seat structure capable of adjusting light source sensing direction as claimed in claim 7, wherein the metallic lid, the inner metallic threaded section, the outer metallic conducting rod, the inner metallic conducting rod, and the outer metallic threaded section are made of copper as conductive members.

9. The lamp seat structure capable of adjusting light source sensing direction as claimed in claim 7, wherein the limit light trough extends away from the outer wall of the cylinder to form an opening facing the metallic lid.

* * * * *